US006079569A

United States Patent [19]

Monteith

[11] Patent Number: 6,079,569

[45] Date of Patent: Jun. 27, 2000

[54] EFFICIENCY ULTRASONIC SIEVING APPARATUS

[75] Inventor: John Monteith, Woking, United Kingdom

[73] Assignee: Russell Finex Limited, Middlesex, United Kingdom

[21] Appl. No.: 09/418,438

[22] Filed: Oct. 14, 1999

[30] Foreign Application Priority Data

Oct. 21, 1998 [GB] United Kingdom ..... 9822880

[51] Int. Cl.[7] ..... B07B 1/42

[52] U.S. Cl. ..... 209/365.1; 209/364; 209/346; 310/328

[58] Field of Search ..... 209/590, 399, 209/403, 409, 364, 365.1, 346; 310/325, 328, 348

[56] References Cited

U.S. PATENT DOCUMENTS

| | | | |
|---|---|---|---|
| 2,880,871 | 4/1959 | Bruninghaus | 209/310 |
| 4,816,144 | 3/1989 | Monteith | 209/364 |
| 5,143,222 | 9/1992 | Monteith | 209/364 |
| 5,386,169 | 1/1995 | Dubrique | 310/323 |
| 5,398,816 | 3/1995 | Senapati | 209/364 |
| 5,542,548 | 8/1996 | Senapati | 209/365.1 |
| 5,595,306 | 1/1997 | Hukki et al. | 209/325 |
| 5,653,346 | 8/1997 | Frei et al. | 209/254 |
| 5,799,799 | 9/1998 | Alamzad et al. | 209/365.1 |
| 5,810,155 | 9/1998 | Hashimoto et al. | 198/630 |
| 5,890,580 | 4/1999 | Hashimoto et al. | 198/619 |
| 6,003,679 | 12/1999 | Maroscher et al. | 209/332 |

FOREIGN PATENT DOCUMENTS

| | | | |
|---|---|---|---|
| 2682050 | 4/1993 | France | 209/365.1 |
| 0542572 | 1/1977 | U.S.S.R. | 209/365.1 |
| 1462866 | 1/1977 | United Kingdom | 209/365.1 |

*Primary Examiner*—Donald P. Walsh
*Assistant Examiner*—David A. Jones
*Attorney, Agent, or Firm*—Marshall, O'Toole, Gerstein, Murray & Borun

[57] ABSTRACT

An ultrasonic sieving apparatus (10) is described which comprises a de-coupler (18) for enabling a combination of a transducer (T) and a first resonator (16) to be supported with respect to a sieve which includes a separation medium (14) provided in a frame (12) such that vibrations generated by the transducer (T) are transmitted to the separation medium (14) via the first resonator (16). The first resonator (16) is of substantially circular cross-section and has first dimensions. The ultrasonic de-coupler (18) which is also of generally circular cross-section and of second dimensions, is connected to and is concentric with the first resonator (16). In use the de-coupler (18) is attached to a bracket (20) adapted to mount the de-coupler (18) onto the frame (12). The first dimensions of the first resonator (16) are such that the resonator (16) is connected to the transducer (T) at an anti-node and the second dimensions of the ultrasonic de-coupler (18) are such that it is connected to the first resonator (16) at a node.

9 Claims, 6 Drawing Sheets

FIG 3a
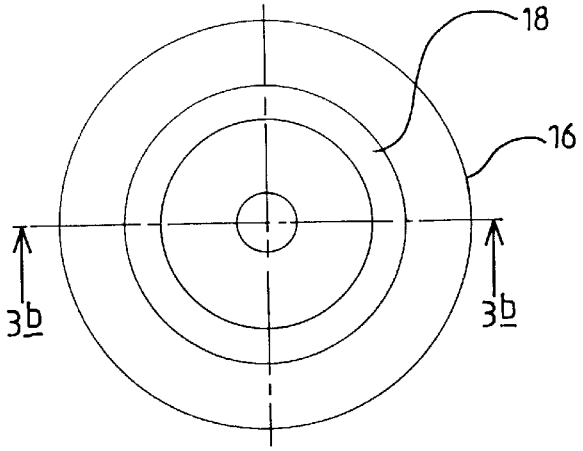
FIG 3b
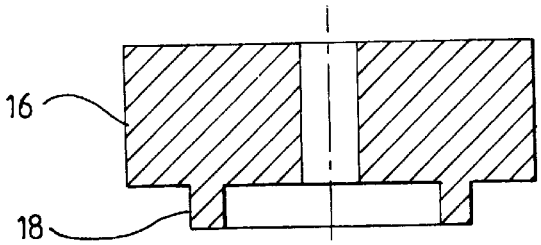
FIG 3c
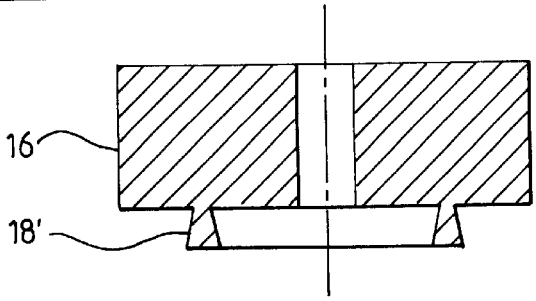
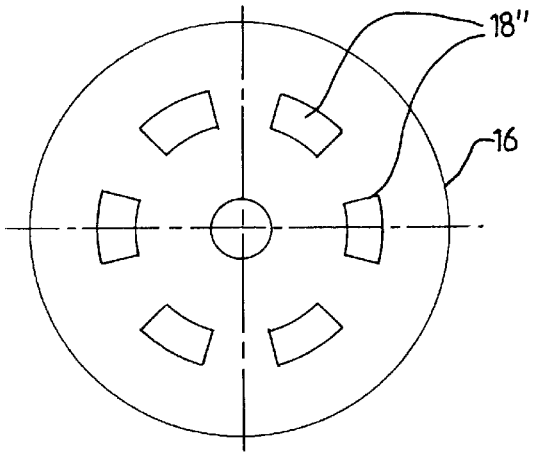
FIG 3d

FIG 5a
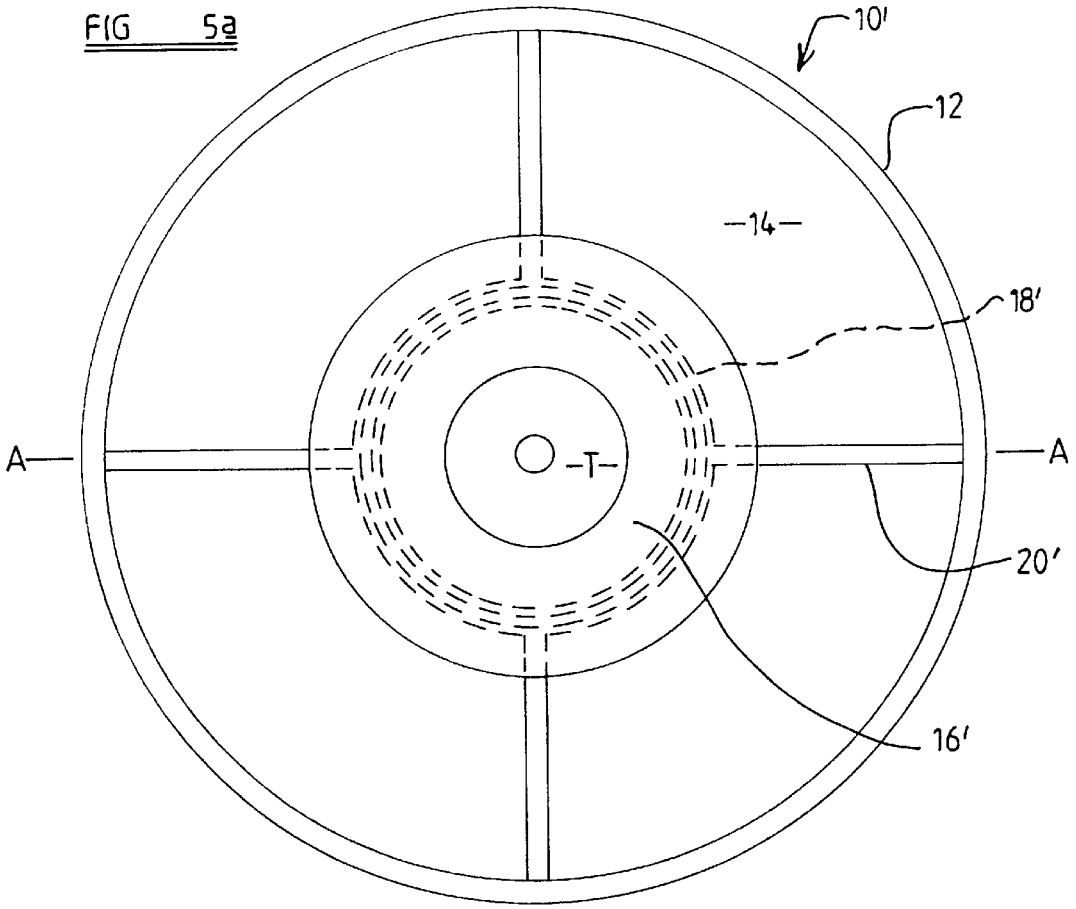
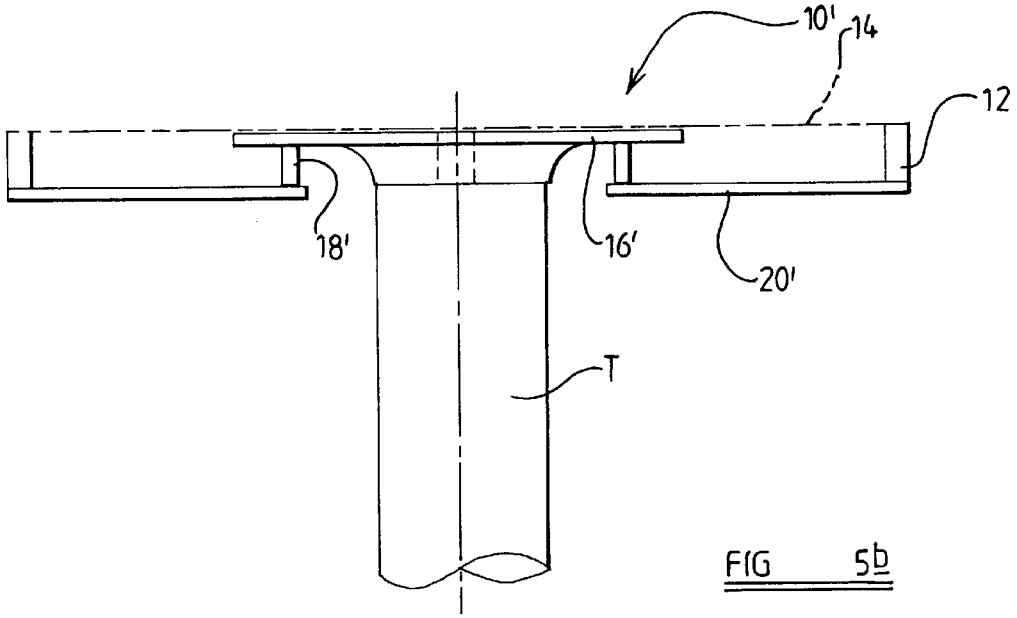
FIG 5b

EFFICIENCY ULTRASONIC SIEVING APPARATUS

BACKGROUND TO THE INVENTION

The invention relates to an ultrasonic sieving apparatus, and in particular to such an apparatus incorporating an ultrasonic de-coupler adapted to provide mechanical support for a transducer and resonator intended to vibrate a sieve or other separation medium.

It is well known to vibrate sieves using ultrasound for many industrial applications, and some laboratory applications. This helps prevent the sieve blinding, and therefore increases the through put of material. Typically the sieve comprises a mesh and a mesh frame in which the mesh is held under tension. A transducer is provided adjacent to the mesh in order to vibrate the mesh, typically the transducer is coupled to a resonator to improve the transmission of the vibrations to the mesh. A second resonator, for example of extended configuration, may be connected to the first resonator to increase the transmission of the vibrations to the mesh.

However, one of the main problems experienced in the prior art is providing the necessary mechanical support for the relatively heavy transducer in such a way that movement of the transducer is prevented whilst avoiding ultrasonic coupling between the transducer and the mesh frame. Such coupling is undesirable as it increases the load on the transducer and decreases the energy efficiency of the apparatus. Indeed, the increased energy input to the system to offset the inefficiency has further negative effects. For example it may cause overheating which may damage any adhesives used in the system, and it may lead to damage of the mesh. Both of these effects can reduce the serviceable lifespan of the sieve thus increasing costs of consumables and increasing downtime of the apparatus.

Various prior art sieving apparatus have incorporated de-couplers which have attempted to overcome these problems, but none are very successful and they tend to be complex in form and thus expensive to manufacture. For example, as illustrated in FIG. 1, it is known to use a cylindrical extension attached to the transducer, which has dimensions such that the resonator connected to it is connected at an anti-node in order to optimise excitation of the resonator. However, the bracket required to support the de-coupler on the mesh frame is also connected at an anti-node thus requiring the bracket to be of complex design in an attempt not to transmit the vibrations to the mesh frame.

It is an object of the invention to provide an alternative form of ultrasonic sieving apparatus comprising a de-coupler which mitigates the above described problems.

SUMMARY OF THE INVENTION

According to the present invention there is provided an ultrasonic sieving apparatus comprising a de-coupler for enabling a combination of a transducer and a first resonator to be supported with respect to a sieve which includes a separation medium provided in a frame, such that vibrations generated by the transducer are transmitted to the separation medium via the first resonator, the first resonator being of substantially circular cross-section and having first dimensions, characterised in that the ultrasonic de-coupler is of substantially circular cross-section and of second dimensions connected to and concentrically with the first resonator and which in use is attached to a bracket adapted to mount the de-coupler onto the frame, the first dimensions of the first resonator being such that the first resonator is connected to the transducer at an anti-node and the second dimensions of the ultrasonic de-coupler being such that it is connected to the first resonator at a node.

The invention provides the advantage that the transducer is more effectively de-coupled from the frame and therefore the transmission of ultrasonic energy to the frame is significantly reduced when compared with the prior art. This reduces energy consumption, reduces the wear and tear on the apparatus and minimises the influence of the frame on the frequency of operation, which in turn reduces tuning problems for different frame sizes.

With the first resonator adapted to vibrate in a diaphragm mode when in use excited by the transducer the second dimensions of the ultrasonic de-coupler are preferably such that in use the de-coupler is attached to the bracket at a diaphragm mode node. Preferably it is also attached to the bracket at a longitudinal mode node.

The de-coupler and/or the first member may be substantially cylindrical. In the alternative the de-coupler and/or the first resonator may have variable generally circular cross-section along their length.

The de-coupler may include portions spaced apart around its generally circular cross-section with gaps therebetween.

The separation medium may comprise a mesh.

Preferably the apparatus further comprises a second resonator adapted to transmit the ultrasonic vibrations from the first resonator to the separation medium.

BRIEF DESCRIPTION OF THE DRAWINGS

An example of an ultrasonic de-coupler according to the invention will now be described, by way of example only, with reference to the accompanying drawings, in which:

FIG. 3 gives a a plan view of, and b a section through the de-coupler incorporated in the apparatus of FIG. 2, whilst c and d show two alternative forms of de-coupler;

FIG. 5 gives a a plan view, b a section through A—A of an alternative form a sieving apparatus according to the invention.

DESCRIPTION OF THE PREFERRED EMBODIMENTS

Figure 2:
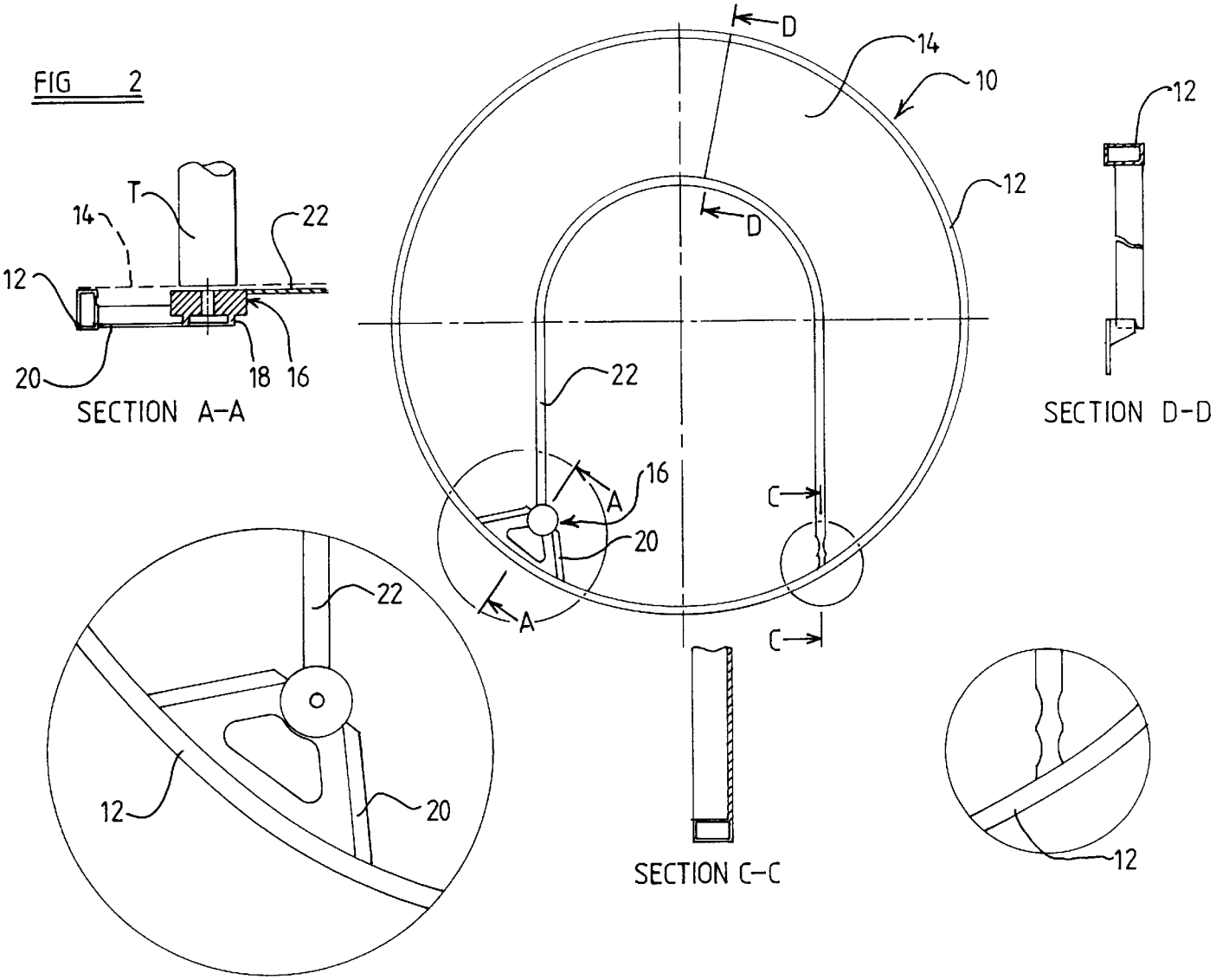
FIG. 2 is a schematic plan view of a sieving apparatus according to the invention.
Figure 4B:
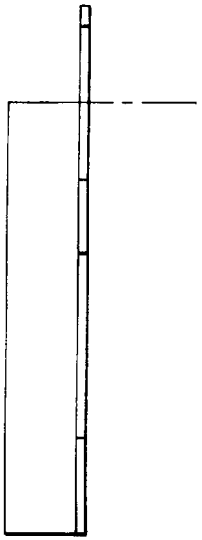
FIG. 4 gives a a plan view, b a section through A—A, and c a lateral view of the bracket incorporated in the apparatus of FIG. 2.
Figure 4A:
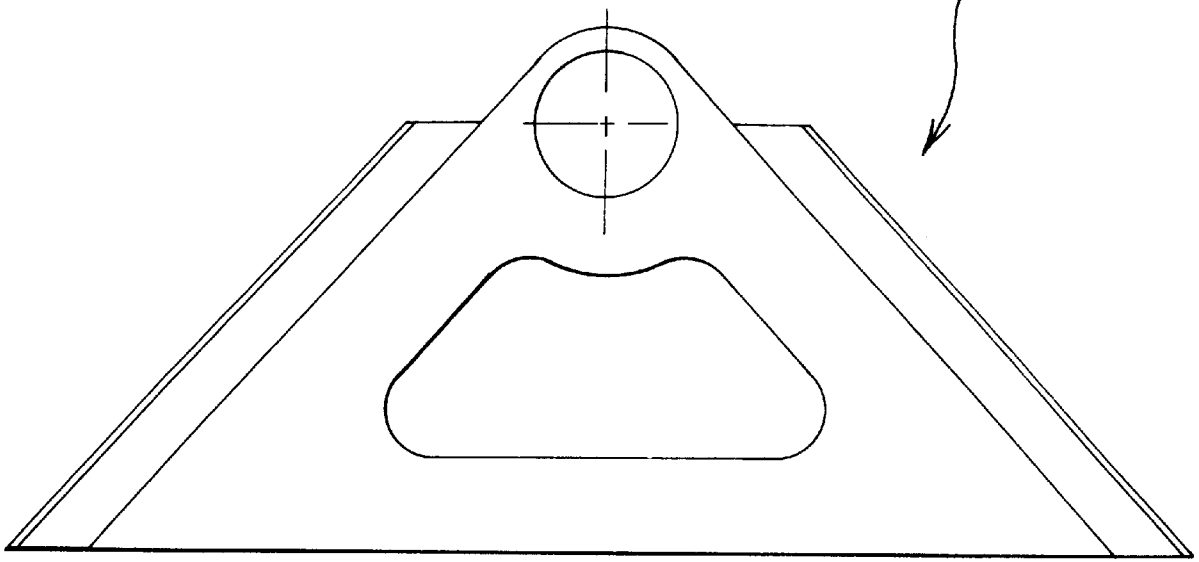
Figure 4C:
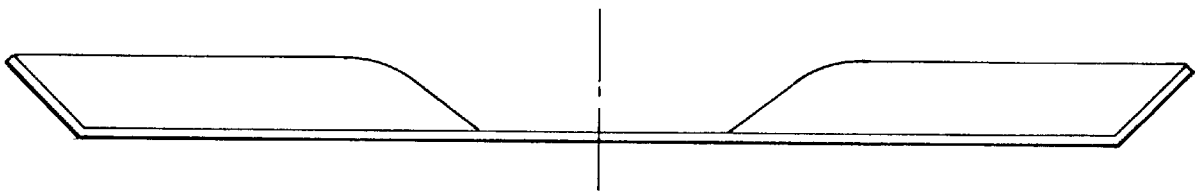

Referring to FIGS. 2 to 4, a sieving apparatus 10 comprises a mesh frame 12 and a mesh 14 held in the mesh frame 12 under tension. An ultrasonic transducer T, for excitation of the mesh 14, is mounted on a first resonator 16, which in turn is mounted on the mesh frame 12 by means of an ultrasonic de-coupler 18 and a bracket 20. A second resonator 22, in this case of extended U-shaped configuration is also connected to the first resonator 16, and is in sonic contact with the mesh 14 in order to excite the mesh 14.

The first resonator 16 and ultrasonic de-coupler 18 together comprise a cylindrical extension to the transducer. The first resonator 16 is of first dimensions, in this example designed to operate at 35 kHz, with an internal diameter of 8.2 mm, an external diameter of 56.75 mm, and a thickness of 20.0 mm. The ultrasonic de-coupler 18 is of second dimensions, in this example with an internal diameter of 30.0 mm, an external diameter of 38.0 mm, and a thickness of 6.0 mm.

The first resonator 16 and de-coupler 18 may be manufactured integral with each other or manufactured separately and subsequently joined together by any appropriate means, such as threads, welding or brazing. In this case they are made integrally from stainless steel. In an alternative the de-coupler could be manufactured integrally with the bracket and subsequently joined to the first resonator.

The dimensions of the first resonator 16 are selected to ensure that it vibrates in a diaphragm mode when excited by the transducer and that the second resonator 22 is connected to it at an anti-node. This ensures maximum excitation of the second resonator 22, and thus maximum excitation of the mesh 14. The dimensions of the ultrasonic de-coupler 18 are selected to ensure that it is connected to the first resonator 16 at a diaphragm mode node, thus minimising the excitation of the de-coupler 18. Preferably the thickness of the de-coupler 18 is also carefully selected to enable the bracket 20 to be connected to it at a longitudinal mode node, thus ensuring minimal excitation of the bracket 20 and hence minimal transmission of ultrasonic energy to the mesh frame 12.

Although the first resonator 16 and de-coupler 18 described here are cylindrical they could take other forms, with circular cross-section, within the scope of the invention. For example they could taper with linear or non-linear variation of cross-section. The cross-section concerned is that taken perpendicular to a longitudinal axis through the components and about which they are rotationally symmetrical. One alternative form of de-coupler of this kind is shown in FIG. 3*c* referenced 18'. Further, rather than being a complete annulus the de-coupler could comprise portions of an annulus evenly spaced about the circle, with gaps therebetween, as shown in FIG. 3*d* referenced 18".

In the above described example the transducer operates at 35 kHz and the apparatus is dimensioned appropriately, although it should be appreciated that the invention applies to other frequencies in the range 10–100 kHz.

The second resonator 22 may be absent or may take any appropriate form, for example a diaphragm resonator, an extended circular planar resonator or indeed a plurality of such resonators.

The bracket 20 may also be of any appropriate form, and in particular may be very simple as it does not need to provide de-coupling as in the prior art. The bracket 20 illustrated in FIG. 4 is pressed, or otherwise manufactured, from sheet steel, with portions along the edges bent upwards to provide additional stiffening without extra weight.

Referring now to FIG. 5 an alternative embodiment of the invention is illustrated. A sieving apparatus 10' comprises a mesh frame 12 and mesh 14 as for the apparatus 10. An ultrasonic transducer T, for excitation of the mesh 14 is mounted on a resonator 16', which in turn is mounted an the mesh frame 12 by means of an ultrasonic de-coupler 18' and a bracket 20'.

The resonator 16' is a substantially circular planar element with a circular swelling on one face in the middle, to which the transducer T is attached, the other face being flat and in-use in sonic contact with the mesh 14. The de-coupler 18' takes the form of a raised annulus on the same face as the swelling but spaced radially outwardly therefrom.

The first dimensions of the resonator 16' and the second dimensions of the de-coupler 18' are such that the de-coupler 18' is connected to the resonator 16' at a diaphragm mode node in order to minimise excitation of the de-coupler 18', bracket 20' and mesh frame 14.

It should be noted that the apparatus 10' only comprises a first resonator 16' and does not include a second resonator, as for the embodiment previously described.

The de-coupler of the invention may be applied to a circular sieve, as in the embodiment described above, or to sieves of other shapes such as, for example, square or rectangular sieves. Likewise the separation medium need not be a sieve mesh but could take any other appropriate form such as a punched plate, membrane, wedgewire etc., for either liquid or powder use.

The resonator employed with the de-coupler may simply be in mechanical contact with the separation medium or may be securely fixed to it by, for example, gluing, welding or soldering, but clearly it must be in sonic contact.

Figure 6:
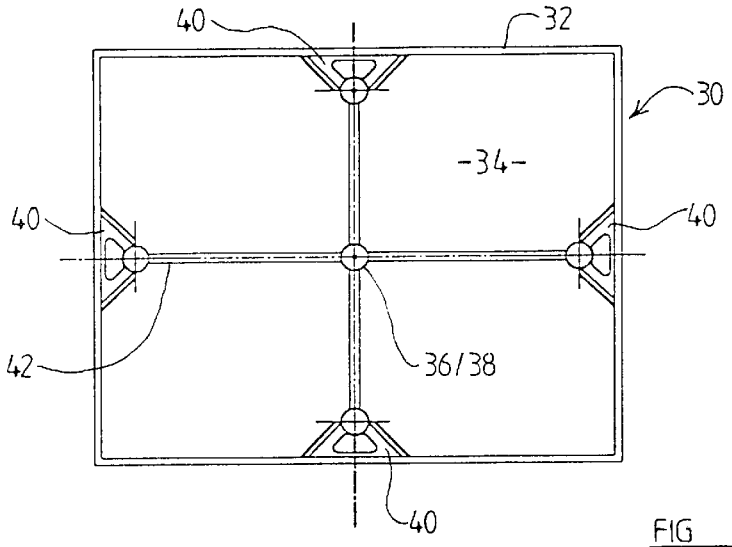
FIGS. 6 to 8 are schematic plan views of alternative embodiments of sieving apparatus according to the invention.
Figure 7:
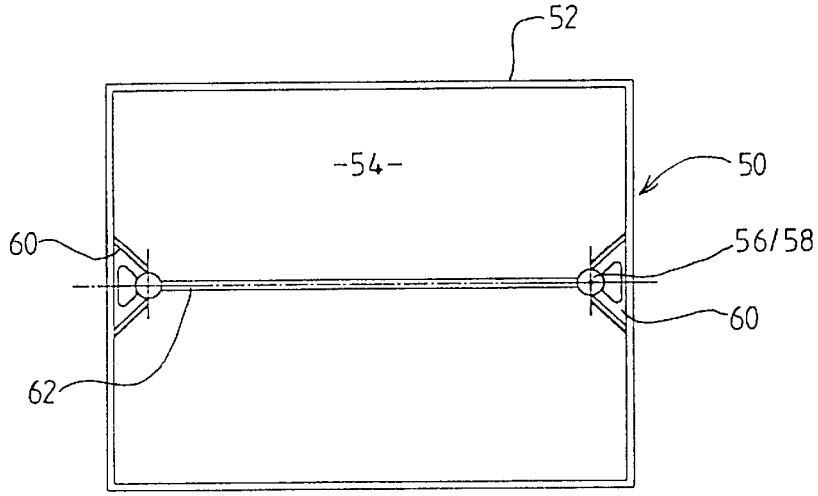
Figure 8:
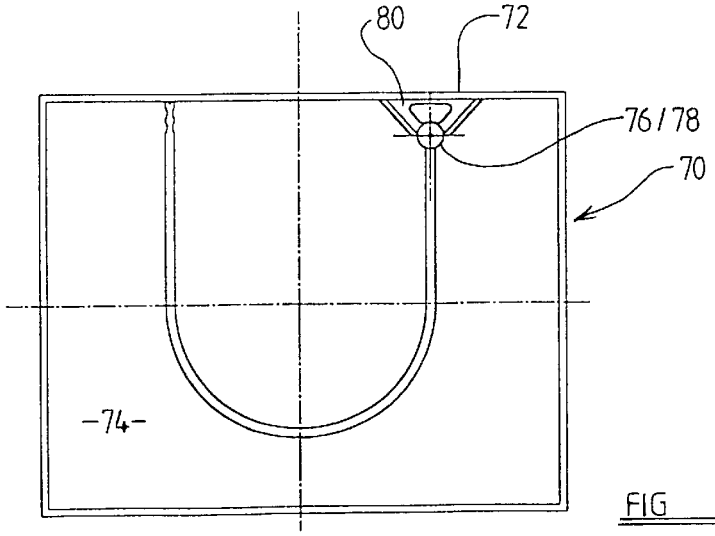

Referring now to FIGS. 6 to 8, three alternative embodiments of sieving apparatus 30, 50, 70, are illustrated.

The apparatus 30 comprises a rectangular mesh frame 32, mesh 34, first resonator 36 and de-coupler 38, brackets 40, and a second resonator 42 in the form of an extended cross. The first resonator 36 and de-coupler 38, and a transducer (not shown) are mounted on the centre of the cross 42.

The apparatus 50 comprises a rectangular mesh frame 52, mesh 54, first resonators 56 and de-couplers 58 mounted on brackets 60, and a second resonator 62 in the form of an extended longitudinal element.

The apparatus 70 comprises a rectangular mesh frame 72, mesh 74, first resonator 76 and de-coupler 78 mounted on bracket 80, and a second resonator 82 in the form of an extended U-shaped element.

Figure 1:
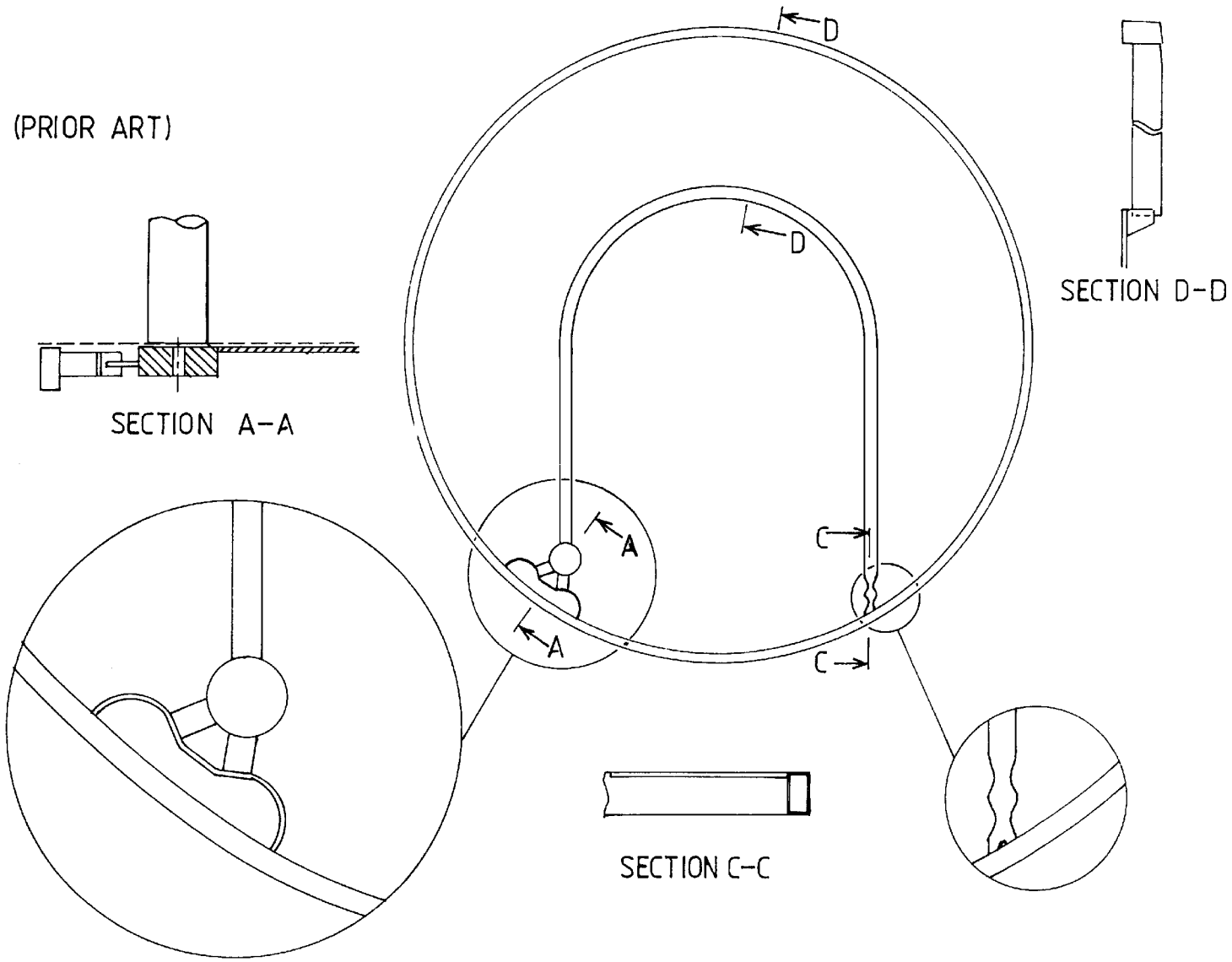
FIG 1 (PRIOR ART)
FIG. 1 illustrates a prior art arrangement.

In the embodiments described above with reference to FIGS. 6 to 8, the first resonator and de-coupler are of the same form as for the apparatus 10 described with reference to FIG. 1.

In the present specification "comprise" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. An ultrasonic sieving apparatus comprising a de-coupler for enabling a combination of a transducer and a first resonator to be supported with respect to a sieve which includes a separation medium provided in a frame, such that vibrations generated by the transducer are transmitted to the separation medium via the first resonator, the first resonator being of substantially circular cross-section and having first dimensions, wherein the ultrasonic de-coupler is of substantially circular cross-section and of second dimensions connected to and concentrically with the first resonator and which in use is attached to a bracket adapted to mount the de-coupler onto the frame, the first dimensions of the first resonator being such that the first resonator is connected to the transducer at an anti-node and the second dimensions of the ultrasonic de-coupler being such that it is connected to the first resonator at a node.

2. An ultrasonic sieving apparatus comprising a de-coupler according to claim 1 wherein with the first resonator adapted to vibrate in a diaphragm mode when in use excited by the transducer the second dimensions of the ultrasonic de-coupler are such that in use it is attached to the bracket at a diaphragm mode node.

3. An ultrasonic sieving apparatus comprising a de-coupler according to claim 2 wherein the second dimensions of the ultrasonic de-coupler are such that in use it is attached to the bracket at a longitudinal mode node.

4. An ultrasonic sieving apparatus comprising a de-coupler according to claim 1 wherein the de-coupler is substantially cylindrical.

5. An ultrasonic sieving apparatus comprising a de-coupler according to claim 1 wherein the de-coupler is of variable substantially circular cross-section along its length.

6. An ultrasonic sieving apparatus comprising a de-coupler according to claim 1 wherein the de-coupler includes a number of portions spaced apart around the generally circular cross-section, with gaps therebetween.

7. An ultrasonic sieving apparatus comprising a de-coupler according to claim 1 wherein the first resonator is substantially cylindrical.

8. An ultrasonic sieving apparatus comprising a de-coupler according to claim 1 wherein the separation medium comprises a mesh.

9. An ultrasonic sieving apparatus according to claim 1 wherein it further comprises a second resonator adapted to transmit the ultrasonic vibrations from the first resonator to the separation medium.

* * * * *